US011276540B2

(12) United States Patent
Gutmann et al.

(10) Patent No.: US 11,276,540 B2
(45) Date of Patent: Mar. 15, 2022

(54) YOKE ASSEMBLY FOR A MAGNETIC SWITCHING DEVICE, SUCH AS A RELAY, MAGNETIC ASSEMBLY, AND MAGNETIC SWITCHING DEVICE

(71) Applicant: Tyco Electronics Austria GmbH, Vienna (AT)

(72) Inventors: Markus Gutmann, Niedernondorf (AT); Philipp Harrer, Karlstein an der Thaya (AT); Bernd Wesely, Dietmanns (AT)

(73) Assignee: Tyco Electronics Austria GmbH, Vienna (AT)

( * ) Notice: Subject to any disclaimer, the term of this patent is extended or adjusted under 35 U.S.C. 154(b) by 323 days.

(21) Appl. No.: 16/414,090

(22) Filed: May 16, 2019

(65) Prior Publication Data

US 2019/0355537 A1 Nov. 21, 2019

(30) Foreign Application Priority Data

May 18, 2018 (EP) ..... 18173144

(51) Int. Cl.
*H01H 50/36* (2006.01)
*H01H 50/18* (2006.01)
*H01H 50/64* (2006.01)

(52) U.S. Cl.
CPC ..... *H01H 50/36* (2013.01); *H01H 50/18* (2013.01); *H01H 50/643* (2013.01)

(58) Field of Classification Search
CPC ..... H01H 50/36; H01H 50/18
USPC ..... 335/203, 95, 130
See application file for complete search history.

(56) References Cited

U.S. PATENT DOCUMENTS 2,140,576 A * 12/1938 Flsher ..... H01H 50/40 310/32
2,916,585 A * 12/1959 Moyer ..... H01H 50/20 335/124
3,739,311 A * 6/1973 Garbark ..... H01F 7/08 335/276
5,905,422 A * 5/1999 Doneghue ..... H01H 50/34 335/78
5,945,900 A * 8/1999 Shibata ..... H01H 50/36 335/234

(Continued)

FOREIGN PATENT DOCUMENTS

DE 19546763 A1 6/1997
EP 1009008 A2 6/2000

OTHER PUBLICATIONS

European Search Report, App No. 18173144.9, dated Nov. 29, 2018, 10 pages.
Abstract of DE 19546763, dated Jun. 19, 1997, 1 page.

*Primary Examiner* — Alexander Talpalatski
(74) *Attorney, Agent, or Firm* — Barley Snyder

(57) ABSTRACT

A yoke assembly for a magnetic switching device comprises a pair of pole faces including a first pole face and a second pole face, a first element, and a second element. The first element has a first section and a second section extending in a direction perpendicular to the first section and forming a part of the second pole face. The second element has a first section extending parallel to the first section of the first element in a mounted state. The second element forms a protrusion of the second pole face projecting beyond the second section of the first element.

16 Claims, 4 Drawing Sheets

(56) References Cited

U.S. PATENT DOCUMENTS

| | | | | |
|---|---|---|---|---|
| 6,486,760 | B2 * | 11/2002 | Miyazaki | H01H 50/36 335/129 |
| 6,765,462 | B2 * | 7/2004 | Noguchi | H01H 50/042 335/128 |
| 7,026,896 | B2 * | 4/2006 | Mikl | H01H 50/36 335/128 |
| 7,679,476 | B2 * | 3/2010 | Kubono | H01H 51/2227 335/78 |
| 7,710,223 | B2 * | 5/2010 | Ota | H01H 50/24 335/4 |
| 10,770,252 | B2 * | 9/2020 | Zhang | H01H 50/26 |
| 2004/0036561 | A1 * | 2/2004 | Reiter | H01H 50/36 335/80 |
| 2009/0315653 | A1 | 12/2009 | Suzuki et al. | |
| 2018/0122604 | A1 | 5/2018 | Zhang | |

* cited by examiner

YOKE ASSEMBLY FOR A MAGNETIC SWITCHING DEVICE, SUCH AS A RELAY, MAGNETIC ASSEMBLY, AND MAGNETIC SWITCHING DEVICE

CROSS-REFERENCE TO RELATED APPLICATION

This application claims the benefit of the filing date under 35 U.S.C. § 119(a)-(d) of European Patent Application No. 18173144.9, filed on May 18, 2018.

FIELD OF THE INVENTION

The present invention relates to a magnetic switching device and, more particularly, to a yoke assembly for a magnetic switching device.

BACKGROUND

A yoke assembly is used in a relay to conduct the magnetic flux used for switching. A problem associated with these yoke assemblies is that, if they are made from two or more parts, the two or more parts must be manufactured with high precision in order to guarantee reliable switching.

SUMMARY

A yoke assembly for a magnetic switching device comprises a pair of pole faces including a first pole face and a second pole face, a first element, and a second element. The first element has a first section and a second section extending in a direction perpendicular to the first section and forming a part of the second pole face. The second element has a first section extending parallel to the first section of the first element in a mounted state. The second element forms a protrusion of the second pole face projecting beyond the second section of the first element.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
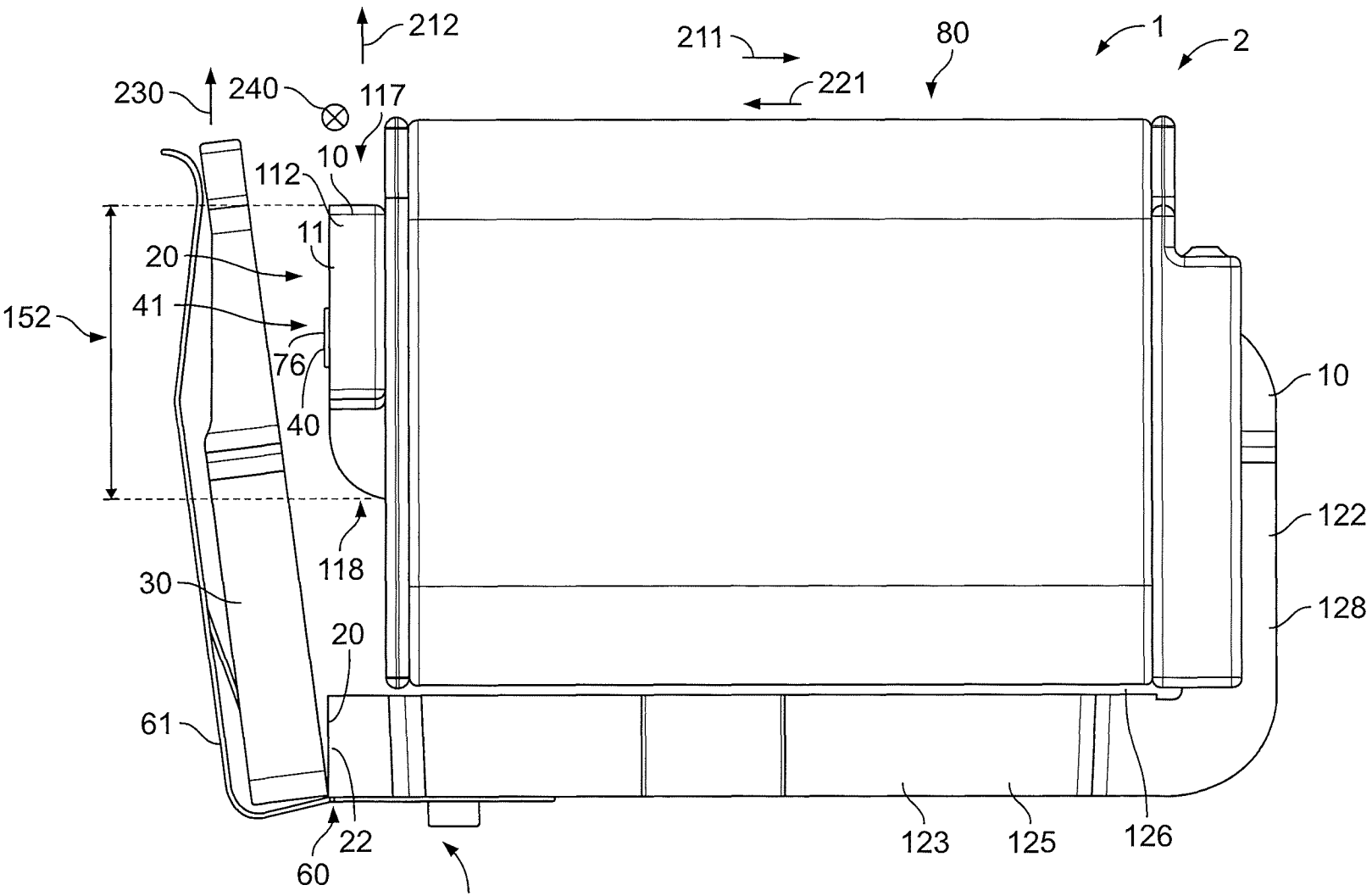
FIG. 1 is a side view of a yoke assembly according to an embodiment in a relay.
Figure 2:
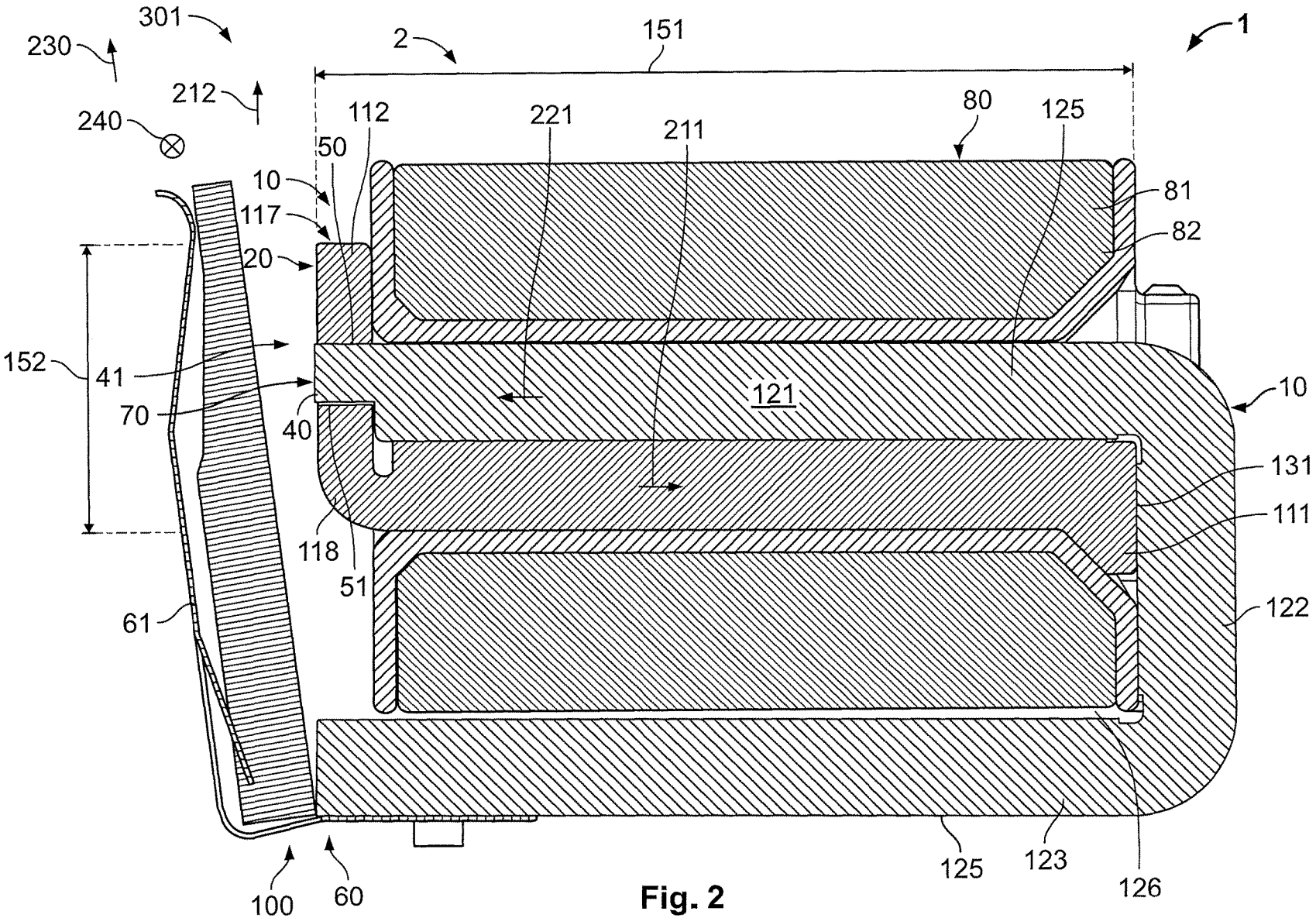
FIG. 2 is a sectional side view of the yoke assembly.

Exemplary embodiments of the present disclosure will be described hereinafter in detail with reference to the attached drawings, wherein like reference numerals refer to like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

A yoke assembly 10 according to an embodiment is shown in FIGS. 1-4. The yoke assembly 10 is part of a magnetic assembly 100, which comprises an armature 30 that can be moved by an electric current running through an electromagnet 80 that partially surrounds the yoke assembly

10. The electromagnet 80 comprises a coil 81 having windings 82. The electric current generates a magnetic flux that is guided by the yoke assembly 10. The magnetic flux leaves the yoke assembly 10 at two pole faces 20 that face towards the armature 30. FIGS. 1-4 show an open position 301 at which the magnetic circuit is not closed. The yoke assembly 10 can be part of a magnetic switching device 1, such as a relay 2.

The armature 30, as shown in FIGS. 1-4, is hingedly connected to the yoke assembly 10 at a joint 60, so that the armature 30 can perform a rotating movement around the joint 60. A spring 61 biases the armature 30 and connects it to the yoke assembly 10. At the area of the joint 60, a first pole face 22 of the pole faces 20 is located next to the armature 30. A second pole face 21 of the pole faces 20 is located away from the joint 60.

Figure 4:
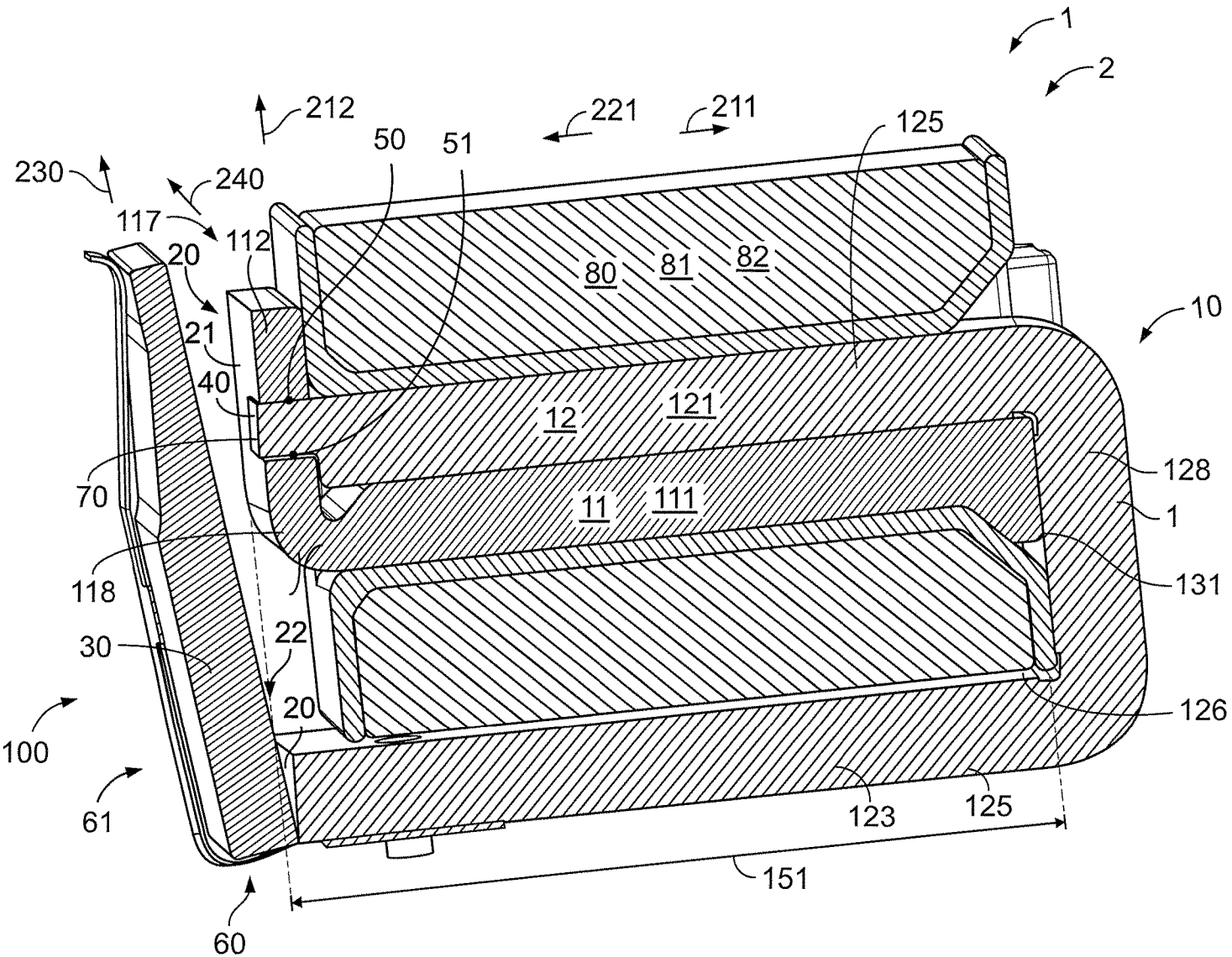
FIG. 4 is a sectional perspective view of the yoke assembly.

The second pole face 21, as shown in FIG. 4, is formed by a first element 11 and a second element 12 of the yoke assembly 10. The first element 11 comprises a first section 111 that extends in a first direction 211 and a second section 112 that extends in a second direction 212 that is perpendicular to the first direction 211. The second section 112 extends away from the joint 60 so that a free end 117 of the second section 112 points away from the joint 60. The first element 11 and second element 12 are separately formed. In an embodiment, each of the first element 11 and the second element 12 can be monolithically formed in a single piece, such as from a sheet metal.

The second element 12, as shown in FIG. 4, comprises a first section 121 that extends in a direction 221 that is parallel to the first direction 211 in which the first section 111 of the first element 11 extends. The second element 12 forms a protrusion 40 that projects beyond the second section 112 of the first element 11. Due to this, the manufacturing process can be simplified as only the second element 12 must be manufactured and assembled with high precision. The first element 11 can be manufactured and assembled less precisely as the armature 30 only contacts the second element 12 in a closed position. The protrusion 40 is the outward most point 41 in an extension direction 211 of the first section 111 of the first element 11 and the extension direction 221 of the first section 121 of the second element 12.

In another embodiment, a plurality of protrusions 40 may project beyond the second section 112 of the first element 11. The plurality of protrusions 40 can be arranged symmetrically and/or on different sides.

As shown in FIGS. 1-4, the second section 112 of the first element 11 comprises an opening 50, which is embodied as a hole 51, through which the second element 12 protrudes in the mounted state. In an embodiment, the opening 50 is a channel-like recess on an outer part of the first element 11. The opening 50 can be positioned centrally on the second pole face 21. The first element 11 is L-shaped, with the first section 111 having a length 151 that is greater than a length 152 of the second section 112 of the first element 11. In another embodiment, the first element 11 can have additional sections and can be T-shaped or S-shaped.

The second element 12, as shown in FIG. 1-4, is U-shaped and comprises the first section 121, a second section 122, and a third section 123. The first section 121 and the third section 123 are two parallel legs 125 of the U-shape that are connected by a base 128 formed by the second section 122. The second element 12 defines a space 126 between the two legs 125 in which the first section 111 of the first element 11 is arranged to save space. In other embodiments, the second element 12 can have a different shape with additional sections.

The first section 111 of the first element 11 and the first section 121 of the second element 12 are complementary to each other and form a common cross-section without gaps between them. This allows for a good conduction of the magnetic flux. In order to improve the flux, an end 131 of the first section 111 of the first element 11 is in contact with the base 128.

As shown in FIGS. 1-4, the protrusion 40 protrudes parallel to the first sections 111, 121 so that forces coming from the armature 30 are received safely. A contact area 70 where the armature 30 contacts the yoke assembly 10 in the closed state is located at the front of the protrusion 40.

Figure 3:
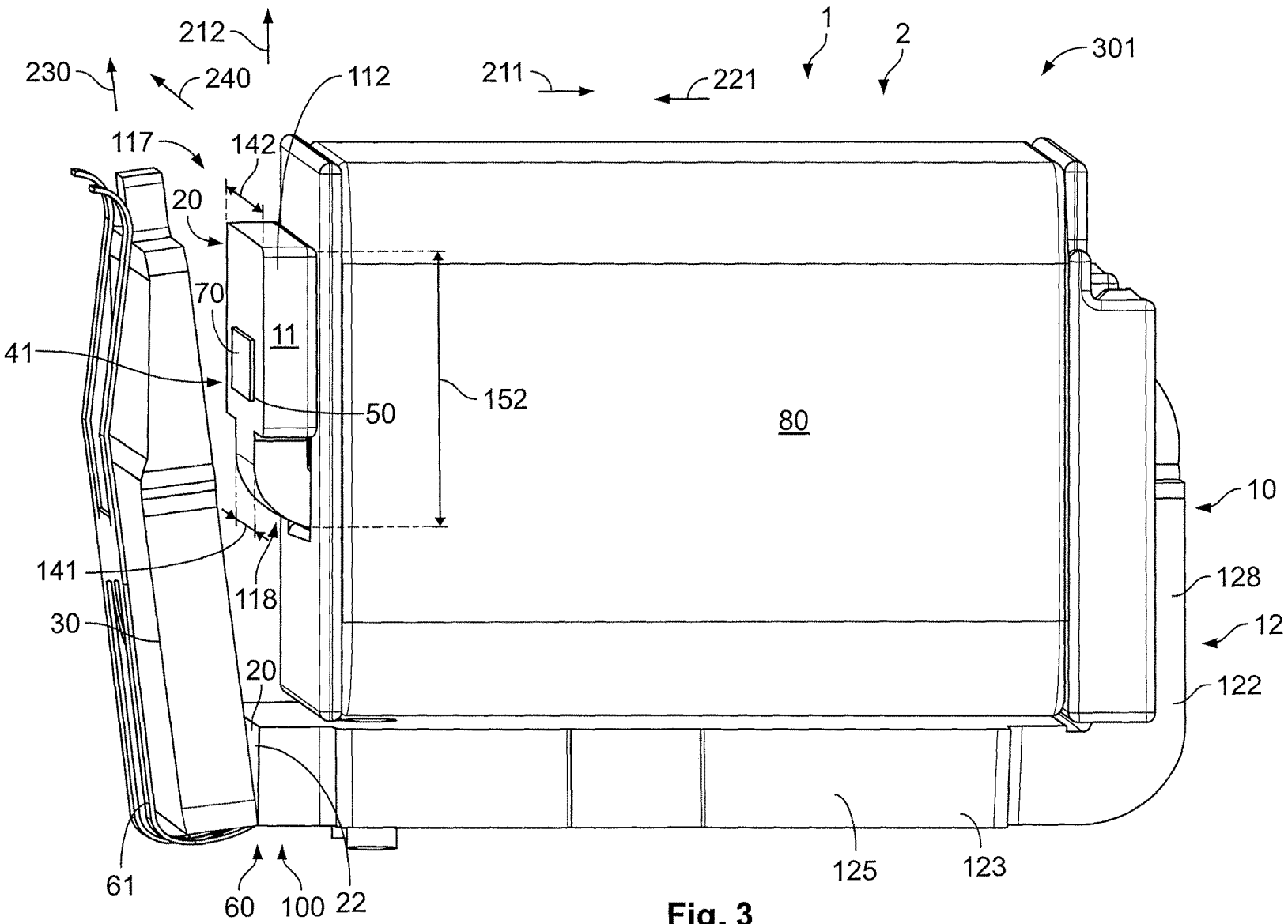
FIG. 3 is a perspective view of the yoke assembly.

The pole face 21, as shown in FIGS. 3 and 4, is enlarged in a width direction 240, which is perpendicular to the extension direction 211, 212. The width 142 at the pole face 21 at the second section 112 is greater than a width 141 of the first section 111 and a bent section 118 connecting the first section 111 and the second section 112.

In the depicted open state shown in FIGS. 1-4, an extension direction 230 of the armature 30 is at a slight angle to the extension direction 212 of the second section 112. In a non-depicted closed state, these two directions can be parallel.

What is claimed is:

1. A yoke assembly for a magnetic switching device, comprising:

a pair of pole faces including a first pole face and a second pole face facing an armature of the magnetic switching device;

a first element having a first section and a second section extending in a direction perpendicular to the first section and forming a part of the second pole face; and a second element having a first section extending parallel to the first section of the first element in a mounted state, the second element forms a protrusion of the second pole face projecting through and beyond the second section of the first element.

2. The yoke assembly of claim 1, wherein the protrusion is an outward most point in an extension direction of the first section of the first element and in an extension direction of the first section of the second element.

3. The yoke assembly of claim 1, wherein the second section of the first element has an opening through which the second element protrudes in the mounted state.

4. The yoke assembly of claim 1, wherein the first element is L-shaped.

5. The yoke assembly of claim 1, wherein the second element is U-shaped.

6. The yoke assembly of claim 5, wherein the protrusion protrudes parallel to a leg of the U-shaped second element.

7. The yoke assembly of claim 6, wherein the first section of the first element is disposed between a pair of parallel legs of the U-shaped second element.

8. The yoke assembly of claim 1, wherein the first section of the first element and the first section of the second element are at least partially complementary.

9. The yoke assembly of claim 1, wherein the second pole face has a width that is wider than other sections of the yoke assembly.

10. The yoke assembly of claim 1, wherein an end of the first section of the first element facing away from the second pole face is in contact with a base of the second element.

11. A magnetic assembly, comprising:

an armature; and a yoke assembly including a pair of pole faces including a first pole face and a second pole face facing the armature, a first element having a first section and a second section extending in a direction perpendicular to the first section and forming a part of the second pole face, and a second element having a first section extending parallel to the first section of the first element in a mounted state, the second element forms a protrusion of the second pole face projecting through and beyond the second section of the first element.

12. The magnetic assembly of claim 11, wherein a contact area at which the armature contacts the yoke assembly is located at the second element.

13. The magnetic assembly of claim 12, wherein the armature is hingedly attached to the second element at a joint.

14. The magnetic assembly of claim 13, wherein the second section of the first element extends in a direction away from the joint.

15. A magnetic switching device, comprising:

a yoke assembly including a pair of pole faces including a first pole face and a second pole face facing an armature of the magnetic switching device, a first element having a first section and a second section extending in a direction perpendicular to the first section and forming a part of the second pole face, and a second element having a first section extending parallel to the first section of the first element in a mounted state, the second element forms a protrusion of the second pole face projecting through and beyond the second section of the first element.

16. The magnetic switching device of claim 15, wherein the magnetic switching device is a relay.

* * * * *